US007472774B1

(12) United States Patent
Monson et al.

(10) Patent No.: US 7,472,774 B1
(45) **Date of Patent: *Jan. 6, 2009**

(54) VERSATILE ENGINE MUFFLING SYSTEM

(75) Inventors: Robert J. Monson, St. Paul, MN (US); Jianhua Yan, Prior Lake, MN (US); Charity R. Van Dusen, Apple Valley, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/341,755

(22) Filed: Jan. 27, 2006

(51) Int. Cl.

| | |
|---|---|
| ***F01N 1/24*** | (2006.01) |
| ***F01N 1/04*** | (2006.01) |
| ***F01N 1/10*** | (2006.01) |
| *F01N 1/02* | (2006.01) |
| *F01N 1/08* | (2006.01) |

(52) U.S. Cl. ..... 181/256; 181/251; 181/257

(58) Field of Classification Search ..... 181/256, 181/264, 269, 272, 275, 252, 249, 255, 258, 181/251, 257, 268, 270, 265

See application file for complete search history.

(56) References Cited

U.S. PATENT DOCUMENTS

| | | | | | |
|---|---|---|---|---|---|
| 701,496 | A | * | 6/1902 | McKinnie | 96/381 |
| 702,031 | A | * | 6/1902 | Ronan | 181/239 |
| 792,804 | A | * | 6/1905 | Williams | 181/265 |
| 1,246,196 | A | * | 11/1917 | Weisberg | 181/268 |
| 1,317,858 | A | * | 10/1919 | Brown | 181/265 |
| 1,721,385 | A | * | 7/1929 | Furnivall et al. | 181/258 |
| 1,891,170 | A | * | 12/1932 | Nose et al. | 60/295 |
| 2,031,702 | A | * | 2/1936 | Frey | 181/256 |
| 2,073,218 | A | * | 3/1937 | Mordt | 181/268 |
| 2,392,247 | A | * | 1/1946 | Katcher | 181/270 |
| 2,929,462 | A | * | 3/1960 | Nowak | 181/252 |
| 2,943,695 | A | * | 7/1960 | Jeffords | 181/243 |
| 2,987,136 | A | * | 6/1961 | Lilley et al. | 181/217 |
| 3,009,530 | A | * | 11/1961 | Cocklin | 181/265 |
| 3,273,666 | A | * | 9/1966 | Hamilton et al. | 181/268 |
| 3,503,465 | A | * | 3/1970 | Yoshihara et al. | 181/252 |
| 3,590,947 | A | * | 7/1971 | Latch et al. | 181/265 |
| 3,602,333 | A | * | 8/1971 | Kobayashi et al. | 181/252 |
| 3,771,315 | A | | 11/1973 | Scott | |
| 3,842,599 | A | * | 10/1974 | Ehlen | 60/273 |
| 3,966,015 | A | * | 6/1976 | Bychinsky | 181/268 |
| 4,056,934 | A | | 11/1977 | Mizusawa et al. | |
| 4,353,434 | A | | 10/1982 | Norris | |
| 4,628,689 | A | | 12/1986 | Jourdan | |
| 4,786,299 | A | * | 11/1988 | DeMarco | 96/382 |
| 4,953,659 | A | | 9/1990 | Norris | |
| 5,036,948 | A | * | 8/1991 | Henn | 181/258 |
| 5,107,953 | A | | 4/1992 | Shimizu et al. | |
| 5,274,201 | A | * | 12/1993 | Steele | 181/224 |
| 5,559,310 | A | * | 9/1996 | Hoover et al. | 181/230 |
| 5,777,947 | A | * | 7/1998 | Ahuja | 367/1 |

(Continued)

*Primary Examiner*—Edgardo San Martin
(74) *Attorney, Agent, or Firm*—Hamre, Schumann, Mueller & Larson, P.C.

(57) ABSTRACT

An engine muffling system includes a Helmholtz tuning chamber to meet the changing acoustic muffling requirements associated with multiple applications. The engine muffling system in one embodiment includes at least one chamber configured as a plenum device, typically filled with an aggregate material or acoustic absorbing particulate material(s) in order to produce a tortuous path through the at least one chamber.

11 Claims, 1 Drawing Sheet

U.S. PATENT DOCUMENTS

| | | | | |
|---|---|---|---|---|
| 5,783,782 | A | 7/1998 | Sterrett et al. | |
| 5,844,178 | A * | 12/1998 | Lothringen | 181/269 |
| 6,068,082 | A | 5/2000 | D'Amico, Jr. et al. | |
| 6,382,347 | B1 * | 5/2002 | Gerber | 181/227 |
| 6,457,552 | B2 | 10/2002 | Maganas et al. | |
| 6,533,657 | B2 * | 3/2003 | Monson et al. | 454/346 |
| 6,672,424 | B2 * | 1/2004 | Gadefait et al. | 181/225 |
| 6,681,879 | B2 * | 1/2004 | Iannarelli et al. | 180/309 |
| 6,991,043 | B1 * | 1/2006 | Chen | 173/169 |
| 2007/0045044 | A1 * | 3/2007 | Sullivan | 181/268 |

* cited by examiner

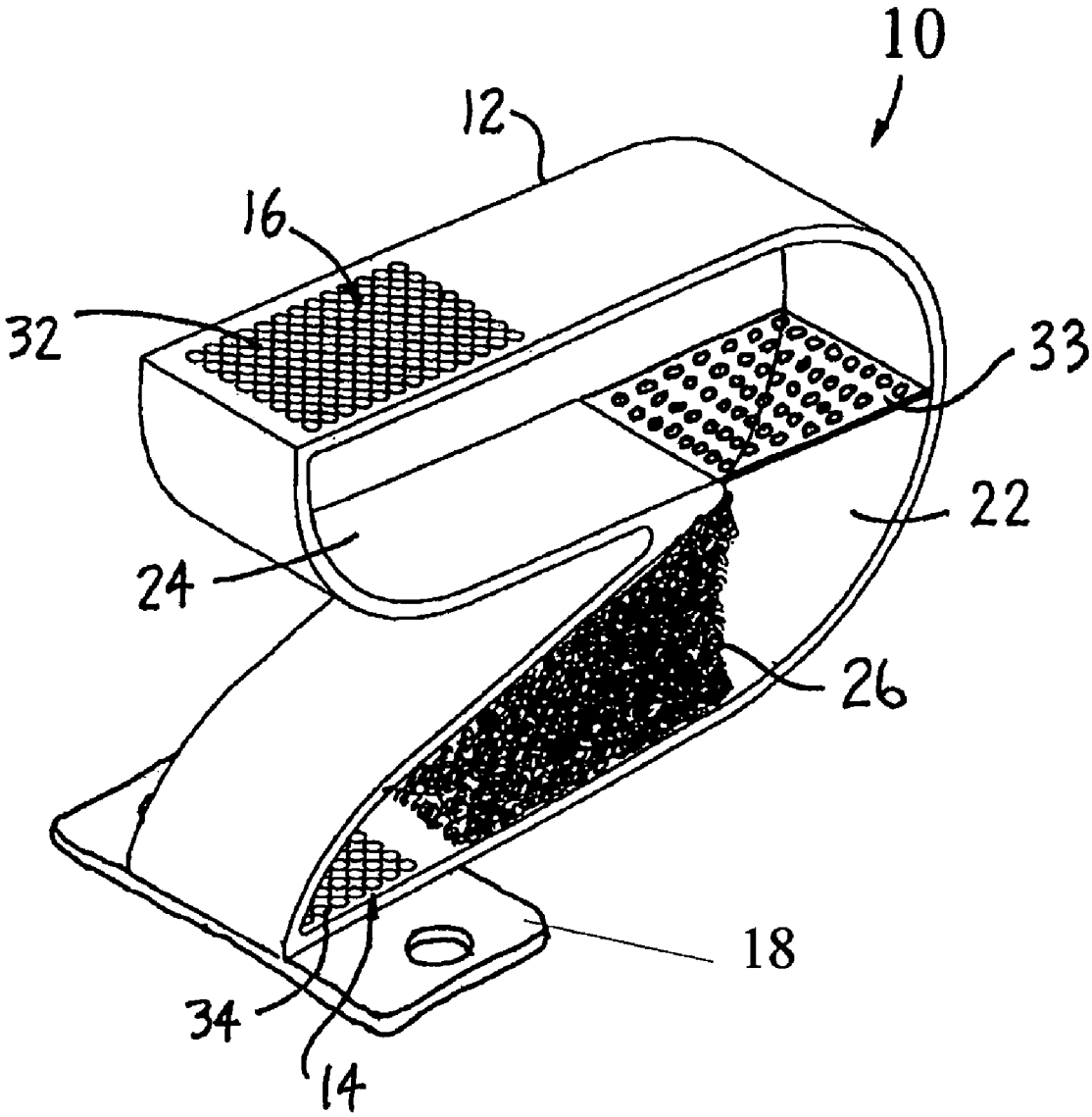
10
12
16
32
33
22
24
26
18
34
14

VERSATILE ENGINE MUFFLING SYSTEM

BACKGROUND OF THE INVENTION

1. Field of the Invention

This invention relates generally to the field of engine muffling systems. More particularly, the invention relates to a muffler having a tortuous path through multiple chambers including a plenum chamber that operates as a Helmholtz tuning chamber.

2. Description of the Prior Art

Mufflers are employed in engine exhaust systems to limit the pressure levels of exhaust noise and to reduce sound levels of exhaust gasses emitted from an engine. Mufflers generally are classified as either reactive or dissipative.

Reactive mufflers generally include a number of resonating chambers of different volumes and shapes connected together with pipes. Reactive mufflers may include flow-reversals or baffles. Such configurations however, produce a relatively high pressure drop, causing a back pressure at the exhaust of the engine, thus limiting engine performance.

Dissipative mufflers generally include ducts or chambers which are filled with acoustic absorbing materials such as fiberglass, steel wool, porous ceramic, and the like. These acoustic absorbing materials absorb the acoustic energy and transform it into thermal energy. Sound absorbing materials generally employed in dissipative mufflers tends to deteriorate because of the structure of the material and the high velocity and temperature of the exhaust.

Sounds or noises associated with engine exhausts are known to be reduced by passage of the exhaust gasses through a plurality of small holes of an elimination chamber so that the gasses react to lower their sound level(s). Expansion chambers are often employed in mufflers by introducing the exhaust gasses into a chamber where they are expanded and then emitted or passed along to further muffler chambers.

While mufflers including a combination of some of the above structures are known in the art in a variety of configurations, such known muffler structures are generally disadvantageous in that they are not compact when employed in vertical exhaust applications. Further, conventional muffler structures, although useful in reducing sounds of exhaust gasses from an engine, are incapable of self-tuning to meet the needs of multiple applications.

In view of the foregoing, it would be advantageous and beneficial to provide a muffler having a single compact structure suitable for providing engine exhaust sound reduction for a plurality of applications, particularly vertical exhaust applications.

SUMMARY OF THE INVENTION

The present invention is directed to an engine muffling system that is self-tuning to meet the requisite acoustic muffling requirements associated with multiple applications. The engine muffling system in one embodiment includes at least one chamber configured as a plenum device, typically filled with an aggregate material or acoustic absorbing particulate material(s) in order to produce a tortuous path through the at least one chamber.

The at least one chamber ultimately serves as a sound attenuation chamber and also as an expansion chamber. The at least one chamber forms a fluidic passageway that is a tortuous path for the engine exhaust gasses.

A sound absorbing material is disposed within the fluidic passageway and within at least one of the chambers to implement a plenum type sound attenuation chamber when the muffler has a plurality of chambers. Each chamber increases continuously in cross-section along the fluidic passageway to also serve as an expansion chamber.

Although conventional sound absorbing materials may be employed for sound attenuation, more non-conventional materials may also be employed. In one such embodiment, the sound absorbing material may include loose particulates such as ceramics, glass, or stones that move in response to engine exhaust sound wave levels and the combustible gases to create a Helmholtz chamber tuning effect.

Thus, an engine muffling system according to one embodiment includes a housing having at least one sound attenuation chamber configured as a fluidic passageway, and further having acoustic absorbing material disposed within the fluidic passageway, such that together, the at least one sound attenuation chamber and the acoustic absorbing material operate to form a tortuous path through a plenum chamber.

According to yet another embodiment, an engine muffling system includes at least one chamber configured as a sound attenuation chamber and further configured as an expansion chamber, together forming a fluidic passageway, and sound absorbing material disposed within the fluidic passageway, such that together, the fluidic passageway and the acoustic absorbing material operate to form a tortuous path through a plenum chamber.

According to still another embodiment, a method of absorbing engine noise includes providing an engine muffler having at least one sound attenuation chamber configured as a fluidic passageway, and further having sound absorbing material disposed within the fluidic passageway, such that together, the fluidic passageway and the acoustic absorbing material operate to form a tortuous path through a plenum chamber, and attaching the muffler to an engine exhaust such that the engine muffler self-tunes itself to provide a desired level of acoustic muffling associated with the engine.

BRIEF DESCRIPTION OF THE DRAWINGS

Other aspects and features of the present invention and many of the attendant advantages of the present invention will be readily appreciated as the same becomes better understood by reference to the following detailed description when considered in connection with the accompanying drawings in which like reference numerals designate like parts throughout the figures thereof and wherein:

The FIGURE is a perspective view of a muffler assembly according to one embodiment of the invention.

While the above-identified drawing FIGURE sets forth a particular embodiment, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

The FIGURE illustrates a perspective view of a muffler assembly 10 according to one embodiment of the invention. The muffler assembly 10 includes a muffler housing 12 with an inlet port 14 at the bottom of the assembly 10 and an exhaust (outlet) port 16 at the top of the muffler housing 12. An engine mounting bracket 18 for attaching the assembly 10 to an upward directed engine exhaust port is attached to the bottom of the muffler assembly 10. The muffler housing 12 has a folded s-shape to advantageously limit the overall assembly height upon attaching the muffler assembly 10 to certain types of aircraft engine exhaust ports. The muffler assembly 10 therefore provides acoustic muffling in applications having vertical space limitations.

A plurality of muffler chambers 22, 24 include sound absorbing materials 26 selectively disposed therein. The sound absorbing materials 26 may be disposed within any one or more of the chambers 22, 24 depending upon the specific application and desired acoustic results. A first muffler chamber 22 provides an inlet passageway for the engine exhaust gases to pass there through. Since muffler chamber 22 includes sound (acoustic) absorbing materials 26, muffler chamber 22 serves as a tortuous plenum for the engine exhaust gases. Subsequent to passing through the first muffler chamber 22, the engine exhaust gases are rerouted through a second muffler chamber 24. The muffler chambers 22, 24 are configured so that the exhaust gases flowing through the chambers 22, 24 are forced to change direction in a manner that prevents the exhaust gases or any portion thereof from passing in a straightline fashion directly between the muffler inlet port 14 and the muffler outlet port 16. This feature further increases the noise attenuation capabilities of the muffler assembly 10. An elimination chamber (not shown) may also be employed to further reduce Sounds or noises associated with engine exhausts. Exhaust gases are passed in a conventional manner through a plurality of small holes within the elimination chamber so that the gases react to further lower their sound level(s).

The shape of the fluidic passageway through the first and second muffler chambers 22, 24 is most preferably implemented in an "S" type pattern. The present invention is not so limited however, and many variations will also suffice to provide the desired fluidic passageway so long as the passageway prevents the exhaust gases or any portion thereof from passing in a straightline fashion directly between the muffler inlet port 14 and the muffler outlet port 16. In this regard, one fluidic passageway that alters the direction of exhaust gas flow by approximately 180° has been found suitable to provide a workable muffler assembly 10.

The first and second muffler chambers 22, 24 most preferably also function as expansion chambers. This feature is implemented by ensuring the fluidic passageway through the chambers 22, 24 increases substantially continuously in cross-section from the inlet port 14 toward the outlet port 16. The fluidic passageway is in fact a tortuous path for the engine exhaust gases, as stated herein before.

First and second muffler chambers 22, 24 are most preferably separated via a screen mesh element 33. A screen mesh element 32 is also positioned at or near the outlet port 16; while another screen mesh element 34 is positioned at or near the inlet port 14. The screen mesh elements 32, 33, 34 allow the engine exhaust gases to pass freely there through while preventing passage of sound absorbing materials that may move or migrate in response to engine exhaust sound wave and/or engine exhaust gas combustion levels. Screen mesh element 32 may be separate from or be integral with a top portion of the housing 12; while screen mesh element 34 may be separate from or be integral with a bottom portion of the housing 12.

Acoustic or sound absorbing materials such as fiberglass, steel wool, porous ceramic, and the like are suitable for use with the muffler assembly 10. Another sound absorbing material that was found by the present inventors to provide a workable muffler assembly 10, includes the use of small particulates. These particulates may be either spherical in shape or may be any combination of random shapes. The size of the particulates may be limited to a particular size (e.g. radius or diameter) or range of sizes. The particulates may be any combination of solid or porous, and may have surface voids or voids extending completely through the particles. Each muffler chamber 22, 24 may incorporate the same or different types of particulates; or one of the chambers 22, 24 may be completely devoid of acoustic absorbing particulates, depending upon the specific application and desired acoustic results to be achieved. The particulates can be constructed of any suitable acoustic absorbing material suitable for use in association with an engine muffling system, such as porous ceramic, discussed herein before, so long as the material can withstand the engine exhaust pressures and temperatures.

The muffler assembly 10 can thus be tuned to a particular engine exhaust simply by altering the amount and location of the particulates within the muffler chambers 22, 24. Only a portion (i.e. 50%) of any chamber 22, 24 can be filled with acoustic absorbing material when using particulates however, in order to prevent unacceptable restriction of engine exhaust gas flow and buildup of backpressures within the muffler assembly 10. The screen mesh 33 prevents particulates from migrating between the chambers 22, 24. As the engine exhaust gas flows along the tortuous path through the muffler chambers 22, 24, the gas ignites. It can be appreciated that some of the particulates will be naturally tuned to the acoustic noise generated via the internal combustion of these gases, and thus will absorb some of the noise caused by the combustion within the muffler assembly 10. The chambers having acoustic absorbing particulates disposed therein, then function as Helmholtz tuning chambers to further enhance the muffling effects.

The invention may be embodied in other forms without departing from the spirit or essential characteristics thereof.

The embodiments disclosed in this application are to be considered in all respects as illustrative and not limitative.

The scope of the invention is indicated by the appended claims rather than by the foregoing description; and all changes which come within the meaning and range of equivalency of the claims are intended to be embraced therein.

What is claimed is:

1. An engine muffler comprising:

a housing having a vertically extending inlet port and a vertically extending outlet port, the outlet port being positioned vertically above the inlet port at a common end of the housing with the outlet port overlapping the inlet port, and the housing further having an internal fluidic passage including a plurality of internal sound attenuating chambers, at least one of the plurality of internal sound attenuating chambers increasing substantially continuously in cross-section along the passage; and acoustic absorbing material disposed within the at least one internal sound attenuating chamber that increases substantially continuously in cross-section such that together the acoustic absorbing material and the at least one internal sound attenuating chamber that increases substantially continuously in cross-section form a tortuous plenum, the acoustic sound absorbing material being in direct contact with exhaust gas flow through the internal fluidic passage.

2. The engine muffler according to claim 1, wherein the acoustic absorbing material comprises particulates that move in response to engine exhaust sound wave levels to create a Helmholtz tuning effect that reduces the engine exhaust sound wave levels.

3. The engine muffler according to claim 1, wherein the internal fluidic passage is configured to direct fluidic flow there through such that engine sound waves do not pass even partially between the inlet port and the outlet port without substantially changing direction with respect to the inlet port.

4. An engine muffler comprising:

a housing having a first end and a second end, the second end being positioned vertically above the first end;

an inlet port at the first end;

an outlet port at the second end;

first and second sound attenuation chambers between the first end and the second end, each sound attenuation chamber having a fluidic passageway there through, and each fluidic passageway increasing substantially continuously in cross-section along the respective passageway from one end of the respective sound attenuation chamber to an opposite end of the respective sound attenuation chamber;

the first and second sound attenuation chambers alter the direction of exhaust gas flow by approximately 180 degrees; and sound absorbing material disposed within at least one of the fluidic passageways and in direct contact with exhaust gas flow.

5. The engine muffler according to claim 4, wherein the sound absorbing material comprises particulates that move in response to engine exhaust sound wave levels to create a Helmholtz tuning effect that reduces the engine exhaust sound wave levels.

6. The engine muffler according to claim 4, wherein the fluidic passageways are configured to redirect fluidic flow there through such that sound waves are caused to change direction in a folded pattern as they pass through the sound attenuation chambers.

7. The engine muffler according to claim 1, further comprising a mesh screen covering the inlet port, a mesh screen covering the outlet port, and a mesh screen separating two of the internal sound attenuating chambers.

8. The engine muffler according to claim 1, wherein the internal fluidic passage alters the direction of exhaust gas flow by approximately 180 degrees.

9. The engine muffler according to claim 1, wherein the internal fluidic passage overlaps itself.

10. The engine muffler according to claim 4, further comprising a mesh screen covering the inlet port, a mesh screen covering the outlet port, and a mesh screen separating the first and second sound attenuation chambers.

11. The engine muffler according to claim 4, wherein the first sound attenuation chamber includes the first end and the inlet port, the second sound attenuation chamber includes the second end and the outlet port, the second sound attenuation chamber overlaps the first sound attenuation chamber, and the outlet port overlaps the inlet port.

* * * * *